US006342677B1

(12) United States Patent
Lee

(10) Patent No.: US 6,342,677 B1
(45) Date of Patent: Jan. 29, 2002

(54) HIGH FREQUENCY CABLE HAVING A DUAL-LAYER STRUCTURE

(75) Inventor: S. Shinn Lee, Jackson, MS (US)

(73) Assignee: Trilogy Communications, Inc., Pearl, MS (US)

( * ) Notice: Subject to any disclaimer, the term of this patent is extended or adjusted under 35 U.S.C. 154(b) by 0 days.

(21) Appl. No.: 09/491,010

(22) Filed: Jan. 25, 2000

Related U.S. Application Data

(60) Provisional application No. 60/138,764, filed on May 25, 1999.

(51) Int. Cl.[7] ..... H01B 7/22
(52) U.S. Cl. ..... 174/106 R; 174/126.2
(58) Field of Search ..... 174/102 R, 106 R, 174/105 R, 126.2, 104, 109, 36

(56) References Cited

U.S. PATENT DOCUMENTS 3,340,353 A * 9/1967 Mildner ..... 174/106 R
3,715,453 A * 2/1973 Aupoix et al. ..... 174/106 R X
4,439,633 A * 3/1984 Grooten ..... 174/106 R
4,510,346 A * 4/1985 Bursh, Jr. et al. .... 174/106 R X
5,111,002 A * 5/1992 Hollander ..... 174/106 R X
6,010,788 A * 1/2000 Kebabjian et al. ..... 174/109 X
6,246,008 B1 * 6/2001 Fluckiger et al. .... 174/126.2 X

* cited by examiner

*Primary Examiner*—Chau N. Nguyen
(74) *Attorney, Agent, or Firm*—Rader, Fishman & Grauer PLLC

(57) ABSTRACT

A coaxial cable has two concentric conducting tubes, each tube being made of two layers. Each layer is formed of a higher conductivity material layered onto a base material, which is also conductive. The higher conductivity layer is disposed on the base layer such that there is an edge clearance of base layer that is devoid of the higher conductivity material. As a result, the edges of the base layers can be welded together to form the coaxial cable without the weld interfering with the conductive characteristics of the high conductivity layer. As a result, the structure provides the RF attenuation performance of the high conductivity layer while allowing selection of the base layer based on material cost and ease of manufacture.

15 Claims, 1 Drawing Sheet

HIGH FREQUENCY CABLE HAVING A DUAL-LAYER STRUCTURE

This application claims the benefit of U.S. Provisional Application No. 60/135,764 filing date May 25, 1999, now abandoned.

TECHNICAL FIELD

The present invention relates to high-frequency cables, and more particularly to a multi-layer high-frequency or coaxial cable and a method for manufacturing the same.

BACKGROUND ART

Coaxial cables and other high frequency cables are known in the art for transmitting, for example, television signals and other communication signals. As shown in FIG. 1, a conventional coaxial cable 100 is formed out of an inner tube 102, a dielectric material 103, and an outer tube 104. The two tubes 102, 104 are made of metal or another electrically conductive material and are disposed concentrically with the dielectric material 103 sandwiched in between the two tubes. The conductivity of the material used to form the tubes 102, 104 and the relative permittivity and dissipation factor of the dielectric material 103 will determine the RF attenuation of the resulting coaxial cable. As is known in the art, at radio frequencies the current flowing through the tubes 102, 104 in the cable 100 tends to flow only in and directly beneath the surfaces of the conducting tubes. This is commonly known as a "skin effect". More particularly, current flows through and directly beneath an inside surface of the outer tube 102 and an outside surface of the inner tube 104.

Each tube 102, 104 is manufactured by bending a flat strip of conductive tape into a round tube and welding the longitudinal edges of the tape together to form a seam. To minimize manufacturing costs, the material selected for forming the tubes 102, 104 is preferably one that is easy to form and weld. However, the materials that provide the best manufacturing characteristics do not necessarily offer the conductivity required for minimizing RF attenuation.

There is a need for a coaxial cable that has high conductivity, to minimize RF attenuation, and yet preserves the ease of manufacture and welding provided by less conductive materials.

SUMMARY OF THE INVENTION

Accordingly, the present invention is directed to a coaxial cable apparatus and method having a dual-layer structure for both its inner and outer tubes. Each tube is formed out of a flat strip having a base layer and a high conductivity layer disposed on the base layer. In a preferred embodiment, the high conductivity layer is disposed on less than the entire surface of the base layer, leaving the margins on the longitudinal edges of the base layer free of high conductivity material to form edge clearances. The flat strip is then bent to form a tube, with the edges of the tube being welded together. The edge clearances allow the edges of the base layer to be welded together without the weld joint touching the high conductivity layer, thereby avoiding potential problems associated with welding materials having different metallurgical properties. The preferred coaxial cable structure is arranged so that the high conductivity layer is on the outer surface of the inner tube and on the inner surface of the outer tube, following the normal current flow pattern in coaxial cables. By providing a separate high conductivity layer for each tube, the inventive dual-layer structure improves the RF attenuation characteristics of the coaxial cable while preserving the ease of manufacture provided by the material used in the base layer.

DETAILED DESCRIPTION OF THE PREFERRED EMBODIMENTS

Figure 2:
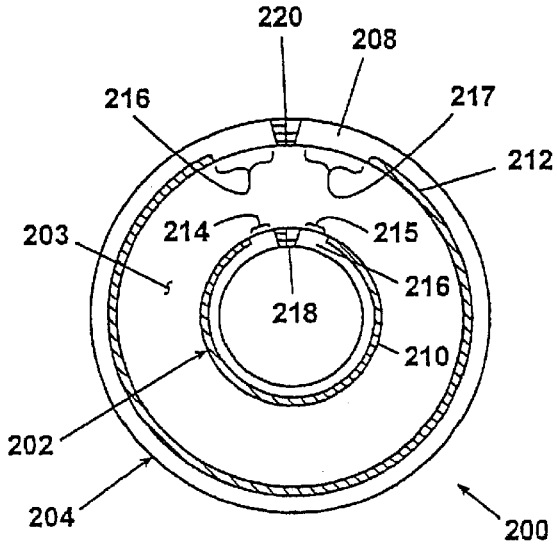
FIG. 2 is a cross-sectional view of a coaxial cable according to the present invention.
Figure 3:
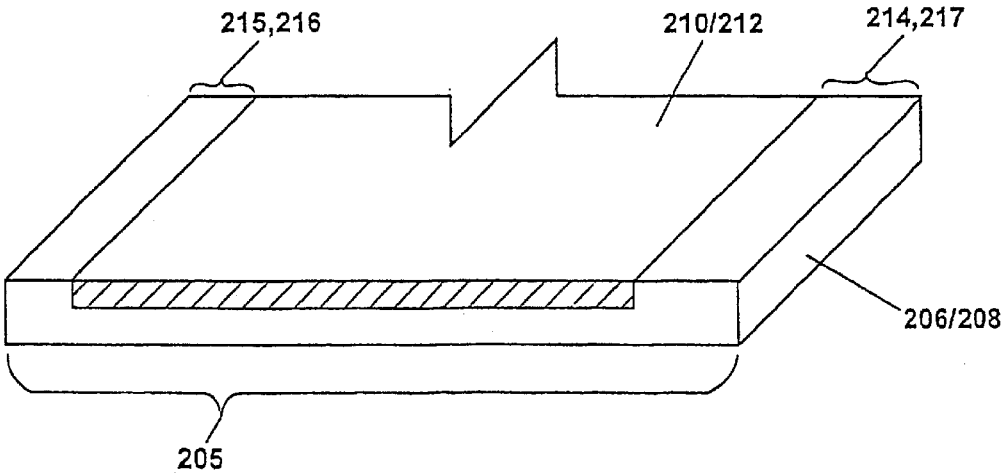
FIG. 3 is a perspective view of a section of a layered strip before it is formed into the inventive coaxial cable.

Referring to FIGS. 2 and 3, a preferred coaxial cable 200 according to the present invention includes an inner tube 202 and an outer tube 204 with a dielectric material 203 disposed in between the inner and outer tubes 202, 204. Both the inner tube 202 and the outer tube 204 are formed from a strip 205, preferably metal, that include a base layer 206, 208 and a high conductivity layer 210, 212 (i.e. low ohmic resistance). The material for the base layer 206, 208 can be selected based on its ease of forming and welding to ensure that the inner and outer tubes 202, 204 can be manufactured efficiently. Possible materials for the base layer 206, 208 include, but are not limited to, steel, aluminum, and copper. The material for the high conductivity layer 210, 212 can be selected based on its conductive characteristics; the forming and welding characteristics of the high conductivity layer 210, 212 are not as important because the edges of the high conductivity layer 210, 212 preferably will not be welded together. Alternatively, or in addition, the selection of the material combination to be used for the high conductivity layer 210, 212 and the base layer 206, 208 is based on the differential thermal expansion between the two materials. Possible materials for the high conductivity layer 210, 212 include, but are not limited to, gold, silver, and copper. The high conductivity layer 210, 212 can be disposed on the base layer 206, 208 using any known method, including cladding, electrodeposition, sputtering, and plating. Both smooth and corrugated cables can be used to form the inventive structure.

As can be seen in FIGS. 2 and 3, the high conductivity layer 210, 212 does not cover the entire base layer 206, 208. Instead, each base layer 206, 208 has edge clearances 214, 216 that are free from the high conductivity material. The edge clearances 214, 215, 216, 217 can be formed by any known means, including selective deposition of the high conductivity material on the base layer 206, 208, machining, etching, sputter deposition, plating, or electrochemical methods. Once the high conductivity layer 210, 212 is deposited on the base layer 206, 208, the corresponding edge clearances 214, 215, 216, 217 for each strip 205 are brought together and welded to form the inner and outer tubes 202,

204. Weld joints 218, 220, which connect the edge clearances 214, 215, 216, 217 together, touch only the base layer 206, 208 because of the margins between the edges of the base layer 206, 208 and the edges of the high conductivity layer 210, 212, which are provided by the edge clearances 214, 215, 216, 217. As a result, the welding material and process can be selected based on the characteristics of only the base layer 206, 208 material, without having to consider the characteristics of the high conductivity layer 210, 212 material or deal with the formation of brittle intermetallics and other problems normally associated with welding materials having different metallurgical properties.

Figure 1:
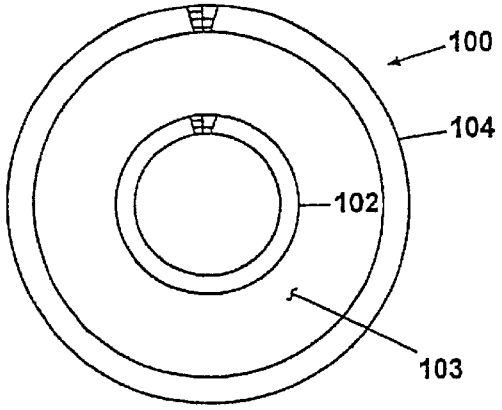
Fig. 1 (PRIOR ART)
FIG. 1 is a cross-sectional view of a prior art coaxial cable structure.

As can be seen in FIG. 2, the inner and outer tubes 202, 204 are arranged concentrically with respect to each other. The resulting coaxial cable 200 has high conductivity layers 210, 212 disposed on the outer surface of the inner tube 202 and the inner surface of the outer tube 204, which are the areas in the coaxial cable 200 through which current flows, as explained above with respect to FIG. 1. The inventive coaxial cable 200 therefore provides high conductivity areas in the regions where current normally flows, allowing the current to flow more freely and thereby reduce RF attenuation, while preserving the ease of welding and forming provided by the material used in the base layer.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A coaxial cable, comprising:

a first base layer having first and second opposing edges;

a first high conductivity layer formed of high conductivity material disposed on the first base layer;

a second base layer having third and fourth opposing edges; and a second high conductivity layer formed of high conductivity material disposed on the second base layer, wherein the first and second opposing edges of the first base layer are connected together to form an inner tube and the third and fourth opposing edges of the second base layer are connected together to form an outer tube that is concentric with the inner tube, wherein the first high conductivity layer is disposed on less than the entire surface of the first base layer to form a first and second edge clearance on the first and second opposing edges of the first base layer, respectively, the first and second edge clearances being free from the high conductivity material, and wherein the inner tube is formed by connecting the first and second edge clearances of the first base layer together.

2. The coaxial cable of claim 1, wherein the second high conductivity layer is disposed on less than the entire surface of the second base layer to form a third and fourth edge clearance on the third and fourth opposing edges of the second base layer, respectively, the third and fourth edge clearances being free from high conductivity material, and wherein the outer tube is formed by connecting the third and fourth edge clearances of the second base layer together.

3. The coaxial cable of claim 1, wherein the first, second, third and fourth opposing edges are connected together via welding.

4. The coaxial cable of claim 1, wherein the first high conductivity layer is arranged to be on an outer surface of the inner tube and the second high conductivity layer is arranged to be on an inner surface of the outer tube.

5. A coaxial cable, comprising:

a first base layer having first and second opposing edge clearances;

a first high conductivity layer formed of high conductivity material disposed on less than the entire surface of the first base layer to leave the first and second edge clearances free from high conductivity material;

a second base layer having third and fourth opposing edge clearances; and a second high conductivity layer formed of high conductivity material disposed on less than the entire surface of the second base layer to leave the third and fourth edge clearances free from high conductivity material, wherein the first and second edge clearances of the first base layer are connected together to form an inner tube and the third and fourth edge clearances of the second base layer are connected together to form an outer tube that is concentric with the inner tube.

6. The coaxial cable of claim 5, wherein the first, second, third and fourth edge clearances are connected together via welding.

7. The coaxial cable of claim 5, wherein the first and second base layers are formed from a material selected from the group consisting of steel, aluminum, and copper.

8. The coaxial cable of claim 5, wherein the first and second high conductivity layers are formed from a material selected from the group consisting of copper, silver and gold.

9. The coaxial cable of claim 5, wherein the first high conductivity layer is arranged to be an outer surface of the inner tube and the second high conductivity layer is arranged to be on an inner surface of the outer tube.

10. A method of manufacturing a coaxial cable, comprising the steps of:

forming a first base layer having first and second opposing edge clearances;

depositing high conductivity material on less than the entire surface of the first base layer to form a first high conductivity layer while leaving the first and second edge clearances free from high conductivity material;

forming a second base layer having third and fourth opposing edge clearances;

depositing high conductivity material on less than the entire surface of the second base layer to form a first high conductivity layer while leaving the third and fourth edge clearances free from high conductivity material;

connecting the first and second opposing edge clearances of the first base layer together to form an inner tube; and connecting the third and fourth opposing edges of the second base layer together to form an outer tube that is concentric with the inner tube.

11. The method of claim 10, wherein the connecting step is conducted via welding.

12. The method of claim 10, wherein the depositing steps include embedding at least one of the first and second high conductivity layers into at least one of the first and second base layers, respectively.

13. A coaxial cable, comprising:

a first base layer having first and second opposing edges;

a first high conductivity layer formed of high conductivity material disposed on the first base layer;

a second base layer having third and fourth opposing edges; and a second high conductivity layer formed of high conductivity material disposed on the second base layer, wherein the first and second opposing edges of the first base layer are connected together to form an inner tube and the third and fourth opposing edges of the second base layer are connected together to form an outer tube that is concentric with the inner tube, wherein the second high conductivity layer is disposed on less than the entire surface of the second base layer to form a third and fourth edge clearance on the third and fourth opposing edges of the second base layer, respectively, the third and fourth edge clearances being free from high conductivity material, and wherein the outer tube is formed by connecting the third and fourth edge clearances of the second base layer together.

14. The coaxial cable of claim 13, wherein the first, second, third and fourth opposing edges are connected together via welding.

15. The coaxial cable of claim 13, wherein the first high conductivity layer is arranged to be on an outer surface of the inner tube and the second high conductivity layer is arranged to be on an inner surface of the outer tube.

* * * * *